US011811139B2

(12) United States Patent
Kim et al.

(10) Patent No.: US 11,811,139 B2
(45) Date of Patent: Nov. 7, 2023

(54) GRADIENT PERMITTIVITY FILM

(71) Applicant: 3M INNOVATIVE PROPERTIES COMPANY, St. Paul, MN (US)

(72) Inventors: Jaewon Kim, Woodbury, MN (US); Stephen J. Etzkorn, Woodbury, MN (US); Ronald D. Jesme, Plymouth, MN (US); Dipankar Ghosh, Oakdale, MN (US); Mohsen Salehi, Woodbury, MN (US); Guanglei Du, Horseheads, NY (US); John A. Wheatley, Stillwater, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 16 days.

(21) Appl. No.: 17/043,432

(22) PCT Filed: Apr. 4, 2019

(86) PCT No.: PCT/IB2019/052760
§ 371 (c)(1),
(2) Date: Sep. 29, 2020

(87) PCT Pub. No.: WO2019/193530
PCT Pub. Date: Oct. 10, 2019

(65) Prior Publication Data

US 2021/0021050 A1 Jan. 21, 2021

Related U.S. Application Data

(60) Provisional application No. 62/654,137, filed on Apr. 6, 2018.

(51) Int. Cl.

| | |
|---|---|
| ***H01Q 15/10*** | (2006.01) |
| ***H01Q 1/32*** | (2006.01) |
| ***H01Q 1/42*** | (2006.01) |

(52) U.S. Cl.
CPC ..... *H01Q 15/10* (2013.01); *H01Q 1/3233* (2013.01); *H01Q 1/3283* (2013.01); *H01Q 1/422* (2013.01)

(58) Field of Classification Search
CPC ..... H01Q 15/10; H01Q 1/42; H01Q 1/422; H01Q 15/08; H01Q 15/02; H01Q 15/06; B29L 2031/3456
See application file for complete search history.

(56) References Cited

U.S. PATENT DOCUMENTS

2005/0200531 A1* 9/2005 Huang ..... H01Q 19/026 343/893
2008/0238811 A1* 10/2008 Winsor ..... H01Q 15/10 343/911 R (Continued)

FOREIGN PATENT DOCUMENTS

CN 205685919 U * 11/2016
JP S 54107655 A 8/1979

(Continued)

OTHER PUBLICATIONS

Fitzek, "Automotive radome design—fishnet structure for 79 GHz", German Microwave Conference Digest of Papers, Berlin, 2010, pp. 146-149.

(Continued)

*Primary Examiner* — Ab Salam Alkassim, Jr.
*Assistant Examiner* — Leah Rosenberg
(74) *Attorney, Agent, or Firm* — Jonathan L. Tolstedt

(57) ABSTRACT

Gradient permittivity films are described. In particular, gradient permittivity films including a plurality of layers each having a thickness where at least one layer is perforated and has a different air volume fraction from another of the plurality of layers by at least 0.05. Such films may be useful in improving the signal to noise ratio for transmitting and (Continued)

receiving units operating between 20 GHz and 300 GHz behind a protective cover.

19 Claims, 4 Drawing Sheets

(56) References Cited

U.S. PATENT DOCUMENTS

2012/0070691 A1* 3/2012 Graf ..... H01Q 1/42 428/701
2012/0326800 A1* 12/2012 Liu ..... H01Q 17/00 333/32
2015/0222011 A1* 8/2015 Kolak ..... F41H 5/0478 156/60
2015/0303584 A1* 10/2015 Liu ..... H01Q 15/0086 343/753
2016/0006129 A1* 1/2016 Haziza ..... H01Q 13/02 343/783
2016/0164187 A1 6/2016 Ohkoshi et al.
2016/0231417 A1 8/2016 Aoki
2016/0351996 A1* 12/2016 Ou ..... H01Q 1/243
2019/0190140 A1* 6/2019 Lavin ..... H01Q 1/422
2019/0296428 A1* 9/2019 Hashimoto ..... H01Q 1/42
2019/0337220 A1* 11/2019 Beyerle ..... H01Q 17/002
2020/0024394 A1* 1/2020 Hanson ..... C08K 3/11
2023/0170604 A1* 6/2023 Jo ..... H01Q 1/42 343/702

FOREIGN PATENT DOCUMENTS

WO 199732356 9/1997
WO 2014057051 A1 4/2014

OTHER PUBLICATIONS

Fitzek, "Comparison of matching layers for automotive radome design", Advances in Radio Science, 2010, vol. 8, pp. 49-54.
Lei, "Fabrication of durable superhydrophobic coatings with hierarchical structure on inorganic radome materials", Ceramic International, Aug. 2014, vol. 40, No. 7, pp. 10907-10914, XP28651344A.
Mirotznik, "Broadband Antireflective Properties of Inverse Motheye Surfaces", IEEE Transactions on Antennas and Propagation, Sep. 2010, vol. 58, No. 9, pp. 2969-2980, XP11311438A.
International Search Report for PCT International Application No. PCT/IB2019/052760, dated Jul. 9, 2019, 5 pages.

* cited by examiner

GRADIENT PERMITTIVITY FILM

BACKGROUND

Radio waves may be reflected at a sharp interface between air and a material having a higher relative permittivity. Such reflections may be undesirable.

SUMMARY

In one embodiment, the present description relates to a gradient permittivity film. The gradient permittivity film includes a first major surface and an opposing second major surface. The gradient permittivity film also includes a plurality of layers, each having a thickness. At least one layer of the plurality of layers is a perforated layer characterized by an average border thickness surrounding each perforation and an average pitch between the centers of each perforation, and an air volume fraction averaged over the thickness of the perforated layer. The perforated layer has a different air volume from another of the plurality of layers by at least 0.05.

DETAILED DESCRIPTION

Figure 1:
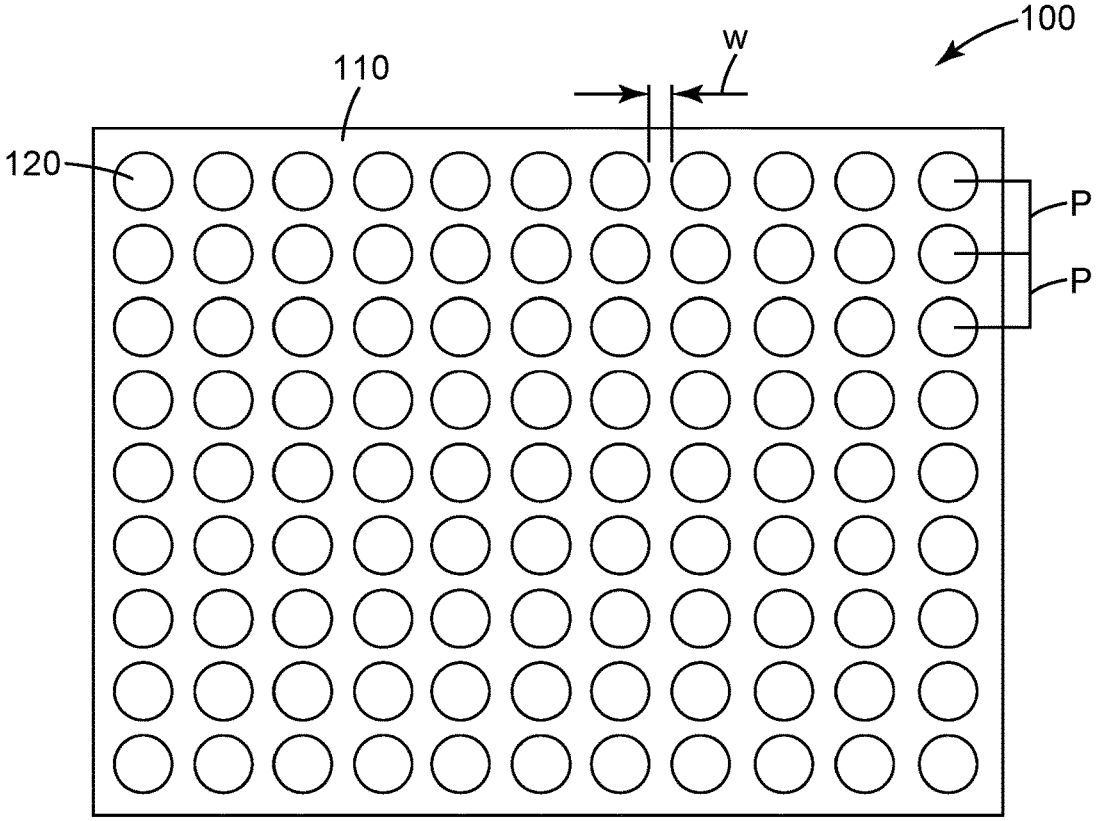
FIG. 1 is a top plan view of a perforated layer.

Radio wave generating and receiving units, such as radar (radio detection and ranging) units, may be useful in a diverse and growing application space. For example, as automobiles incorporate more and more sensors in order to enhance driver safety, sense and warn about vehicle surroundings and ambient conditions, and to enable partial or full autonomous driving functions, one or more radar units may be incorporated. For automotive radar applications, microwave generation and receiving units may be used, and so for purposes of this application "radar" and "radio waves" shall include microwave range frequencies as well. For power consumption, safety, and regulatory reasons, these radar units may be relatively low power when compared to those used for, as an example, air traffic monitoring applications. Accordingly, the signal to noise ratios of these lower power units may be more sensitive to interference or attenuation.

In order to protect these radar units from dirt buildup or weather elements such as snow and rain, or, in the case of rotating or moving components, to protect people from injury or accidental damage, the unit is typically protected with a cover. In some cases, this protective cover is referred to as a radome. Alternatively or additionally, these units are sometimes embedded within the body of the vehicle. In some embodiments, these units are placed behind or within the bumper fascia or another vehicle fascia, which serves as the protective cover. Depending on the direction of interest, these radar units can be placed at any location on the vehicle.

Typically, they are arranged so that the least amount of material is disposed between the radar unit and its potential—or intended—targets for detection.

However, because a protective cover is typically necessary or desirable to use in conjunction with these radar units, the radio waves generated by a radio wave generating unit and received by a radio wave receiving unit must pass through a interface including a sudden increase in electrical permittivity. Relative permittivity for a given frequency, which, as used herein is the ratio of a material's permittivity to the permittivity of a vacuum, measures the resistance of a material to forming an electric field within itself. Sharp changes in this value as would be encountered by a radio wave travelling in air at an interface with a non-air material, such as a plastic vehicle fascia, will cause at least some of the radio wave to be reflected at this boundary. Since these boundaries occur twice for each pass through the vehicle fascia (once entering the material and once exiting the material), the losses represented by reflections in a non-desirable direction (for radio waves generated by the radio wave generating unit, back toward the radio wave generating unit, and for radio waves to be received by the radio wave receiving unit, back away from the radio wave receiving unit), can become significant and make the signal less effective. Specifically, this can happen either because a returning signal is significantly attenuated before being detected by the radio wave receiving unit or because a transmitted signal is reflected and detected, giving a strong false signal, either mechanism reducing the ability to discern a desirable signal from noise. Similarly, antennas for telecommunications or, indeed, for any electronic device including a transmitting and receiving unit may encounter the same or similar problems; i.e., signal losses or noise increases attributable to a sharp transition between medium permittivity.

Gradient permittivity films—analogous to antireflection films or coatings for optical interfaces, provide a smooth or stepped change in permittivity (versus a smooth or stepped change in refractive index for antireflection films)—from a first medium to a second medium. Typically, the gradient permittivity film's permittivity varies from being closest to the permittivity of the first medium to being closest to the permittivity of the second medium. For example, the gradient permittivity film could have a varying permittivity that starts close to the permittivity of air on one side and transitions to the permittivity of a plastic vehicle fascia on the other side (which would be attached to the plastic vehicle fascia). This smooth or stepped transition can significantly reduce the dielectric boundary reflection that otherwise occurs at these sharp transitions.

Previous gradient permittivity films typically use varying bulk three-dimensional shapes, such as cones or pyramids. However, in a typical use environment where these films may be exposed to dirt accumulation and weather conditions, these films may become contaminated and ineffective, because they rely on the presence of air in order to provide the gradient in permittivity. Films described herein may be less susceptible to debris and contaminant ingress because a limited portion of the air or gas fraction is exposed to external elements.

FIG. 1 is a top plan view of a perforated layer. Perforated layer 100 includes material 110 and perforations 120. Material 110 may be any suitable material and may be formed through any suitable means. In some embodiments, material 110 may be formed from a polymeric resin, including polyethylene terephthalate, polycarbonate, poly(methyl methacrylate), polystyrene, polyurethane, or any other polymer or copolymer and blends thereof. In some embodiments, material 110 can include an absorber composite. The absorber composite may include at least one of ceramic filler materials, conductive filler materials, or magnetic filler materials. The conductive filler materials may include, for example, carbon black, carbon bubbles, carbon foam, graphene, carbon fibers, graphite, carbon nanotubes, metal particles, metal nanoparticles, metal alloy particles, metal nanowires, polyacrylonitrile fibers, or conductive coated particles. The ceramic material fillers may include, for example, cupric oxide or titanium monoxide. The magnetic filler materials may include, for example, Sendust, carbonyl iron, permalloy, ferrites, or garnets. Materials may be selected for their ease of processing, environmental stability, or any other property or combination of properties relating to the material's use in the desired application. For example, in some embodiments, perforated layer 100 may be formed from material 110 suitable to manufacture through injection molding. In some embodiments, perforated layer 100 may be formed from material 110 suitable to manufacture through a microreplication process, such as a continuous cast and cure process. In some embodiments, perforated layer 100 may be formed from material 110 manufactured as a cast film. In some embodiments, perforated layer 100 may be formed from material 110 deposited through an additive three-dimensional printing process. In some embodiments, perforated layer 100 may be formed through a selective curing of a photoresist, such as through a two-photon process. In some embodiments, perforated layer 100 may be formed from material 110 formed through ablation, etching, photolithography, or a similar process to remove material and form the desired shape. In some embodiments, material 110 may include air or other inert gas bubbles or voids, or glass or plastic microbubbles, cenospheres, or porous ceramic particles to lower the effective permittivity of the material. In some embodiments, perforated layer is coated with an inorganic material. In some embodiments, this material is different from any material in the perforated layer. For example, the perforated layer may be coated with one or more of alumina or titania.

Perforated layer may be any suitable thickness. The selection of the thickness may take into account physical robustness and environmental stability (such as resistant to heat-cool cycle warping). Additionally, the suitable thickness may also be bounded as being greater than a minimum thickness so that a radio wave or other electromagnetic wave of interest experiences and interacts with the intermediate change in permittivity. If the thickness is too thin, an incident electromagnetic wave will not interact with the gradient permittivity film. Or, in the case of multilayer gradient permittivity films including a plurality of perforated layers, an electromagnetic wave will interact with the multilayer gradient permittivity film as if it were a single layer of a blended effective permittivity—instead of, as desired, as a film of stepped permittivity from each individual layer. If a film is too thick, it may not be effectively attached or may not remain attached to a surface, and may be less flexible or conformable than desired.

In FIG. 1, perforated layer 100 is characterized by a plurality of perforations 120. Perforations may be any shape or size and may be arranged regularly or irregularly. In some embodiments, each of perforations 120 is the same size and shape. In some embodiments, one or more of the size and shape of perforations 120 vary over perforated layer 100. In some embodiments, one or more of the size and shape of perforations may vary monotonically or smoothly over at least one non-thickness direction. In some embodiments, one or more of the size and shape of the perforations may vary nonperiodically or pseudorandomly.

For regularly arranged perforations, as those shown in FIG. 1, these can be characterized by a width w between perforations corresponding to an average border thickness and a pitch P which is the space between the areal center of one perforation to its next neighbors. In some embodiments, both pitch and width can be averaged over the layer. In some embodiments, to avoid characterizing perforations near the edge which may require thicker borders for stability or robustness, the characterization of the width and pitch may be done for a limited portion near the center of the layer, such as a 1 mm×1 mm square or a 5 mm×5 mm square, ignoring any perforations only partially within that area.

Even for perforations that may not be regularly arranged or may vary over one or more non-thickness directions of the perforated layer, an average border thickness (width) and pitch can be computed and characterized for the layer.

The specific perforation arrangement can lead to the calculation of the air or gas volume fraction for the perforated layer. In some embodiments, the air volume fraction of the perforated layer may be as low as 0 or 0.01 or 0.1 or as high as 0.25, 0.5, 0.75, 0.8 or higher.

In some embodiments, the perforations may be canted or aligned with respect to the thickness direction of the perforated layer. For example, a perforation axis along the center of each perforation may not deviate by more than 30 degrees from a direction along the thickness. As with all other perforation characteristics described herein, such canting can be designed to vary smoothly, periodically or nonperiodically along one or more non-thickness directions.

For ease and practicality of certain manufacturing techniques, in some embodiments, perforations 120 may not fully extend through the thickness of perforated layer 100. Instead, perforated layer 100 may have "land," or a continuous layer of material along at least one side of the perforated layer.

Figure 2:
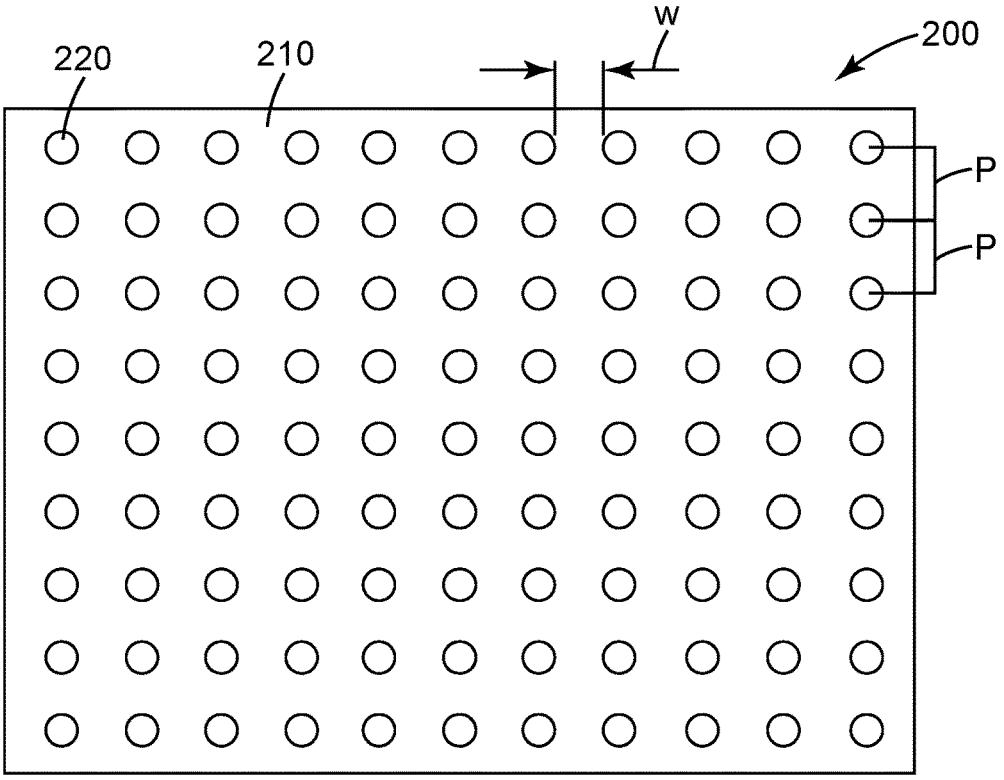
FIG. 2 is a top plan view of another perforated layer.

FIG. 2 is a top plan view of another perforated layer. Perforated layer 200 includes material 210 and perforations 220. FIG. 2 is similar to FIG. 1, however, perforated layer 200 has a thicker average border thickness and width w than for perforated layer 100 in FIG. 1.

Figure 3:
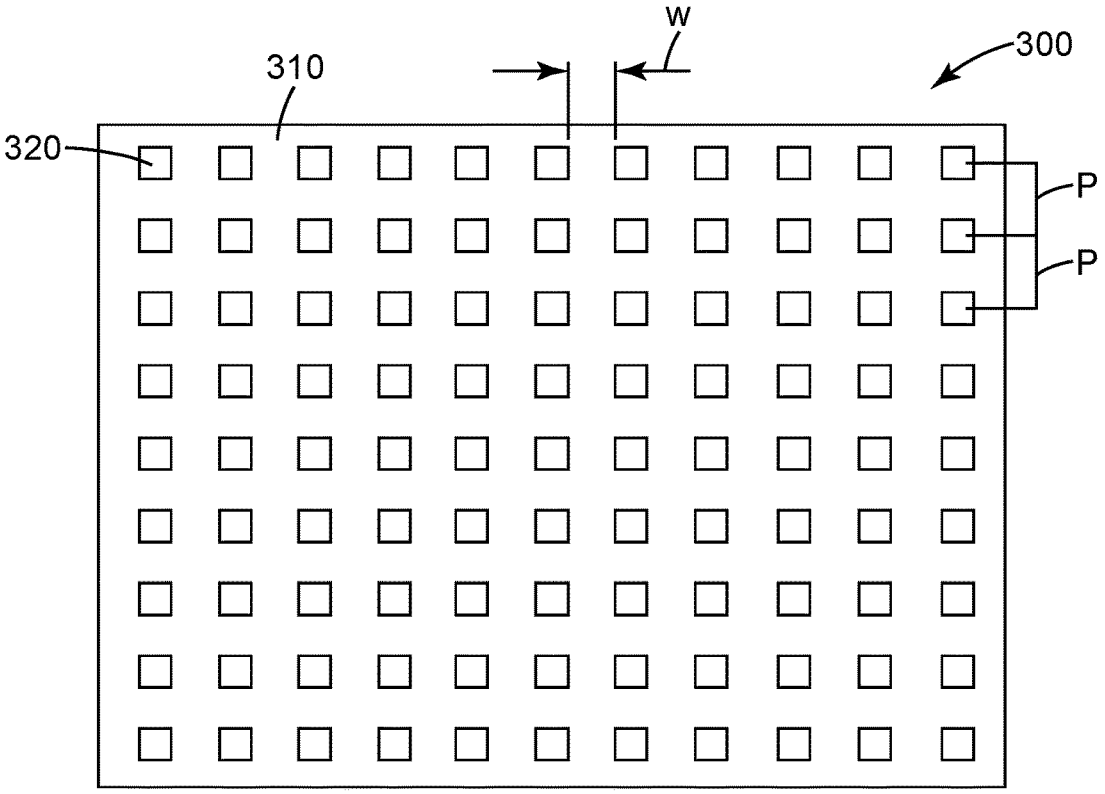
FIG. 3 is a top plan view of another perforated layer.

FIG. 3 is a top plan view of another perforated layer. Perforated layer 300 includes material 310 and perforations 320. Perforated layer 300 includes perforations that are shaped as squares (from a plan view). Even though perforated layer 300 has perforations 320 with a different shape than perforated layer 200, the size, w, and P are similar. Of course, any variation or combination of features or properties of these perforated layers, for example, in shape, size, arrangement, or pattern is possible depending on the desired application.

Figure 4:
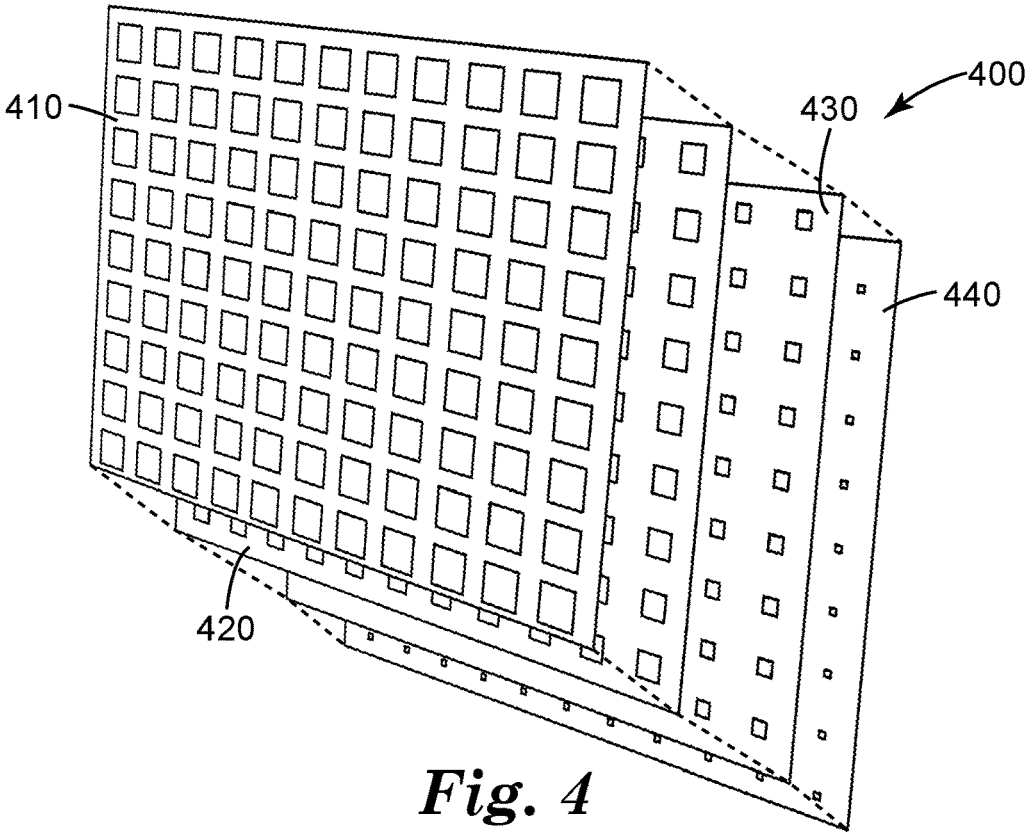
FIG. 4 is an exploded top perspective view of a gradient permittivity film.

FIG. 4 is an exploded top perspective view of a gradient permittivity film. Gradient permittivity film 400 includes first layer 410, second layer 420, third layer 430, and fourth layer 440. Each of the layers is attached or laminated to adjacent layers, either adhesively or through any other suitable method. The layers of gradient permittivity film 400 vary from having a large air volume fraction in first layer 410 to having a smaller air volume fraction in fourth layer 440. The air volume fractions of adjacent layers may differ in some embodiments by at least 0.05. Given the low relative permittivity of air, gasses, or partial vacuums, the inclusion of air or any other gas or partial vacuum within each perforated layer lowers the effective permittivity of that perforated layer. The depiction of four layers in FIG. 4 is meant to be exemplary and any number of suitable layers—more or less—may be stacked in order to provide the desired stepped permittivity.

Figure 5:
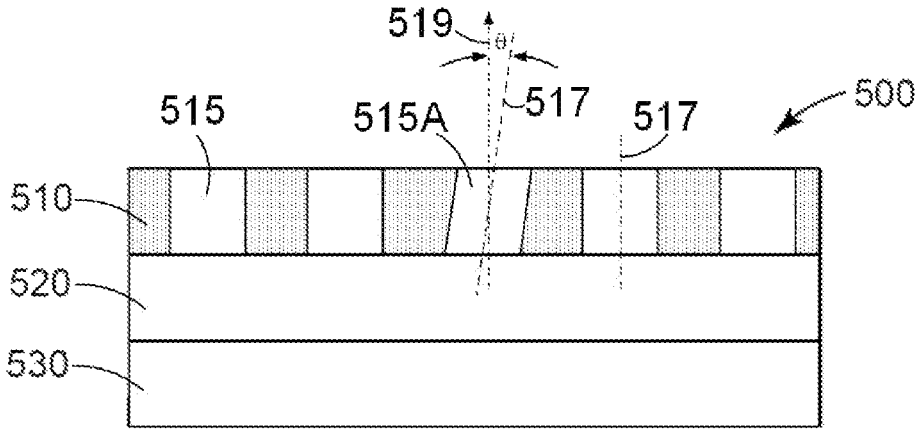
FIG. 5 is a side elevation cross section of a gradient permittivity tape.

FIG. 5 is a side elevation cross section of a gradient permittivity tape. Gradient permittivity tape includes perforated layer 510, adhesive layer 520, and backing layer 530. FIG. 5 shows a gradient permittivity tape using perforated layer 510 to provide an intermediate permittivity. Perforated layer 510 may be any of the perforated layers described herein with any desired air volume fraction. As in FIG. 4, any number of layers may be used in order to achieve the desired gradient: for ease of illustration a single perforated layer is shown. Perforated layer 510 may include a plurality of perforations 515. Each perforation 515 may be canted or aligned with respect to the thickness direction 519 of perforated layer 510. For example, a perforation axis 517 along the center of each perforation 515 (for example, perforation 515A) may not deviate by more than 30 degrees from a direction 519 along the thickness of perforation 515A, (that is, the angle θ in FIG. 5 may not be greater than 30 degrees.) The angle θ (defining the amount of canting) can be designed to vary smoothly, periodically, or nonperiodically from one perforation 515 to another perforation 515 along one or more non-thickness directions.

Adhesive layer 520 may include any suitable adhesives, including pressure sensitive adhesives, repositionable adhesives, or stretch releasable adhesives. Adhesive layer 520 may be any suitable thickness to provide secure contact to a surface with which it is attached. Adhesive layer 520 may alternatively include curable components, such as UV-curable components or heat curable components. In some embodiments, adhesive layer 520 may also include one or more of inert gas or air components, such as glass or plastic microbubbles, cenospheres, ceramic particles, or free voids, in order to further control the permittivity gradient. In some embodiments, the adhesive layer may be textured or patterned in order to include an air or gas fraction within its volume.

Backing layer 530 may include any suitable film or layer to protect the adhesive properties of adhesive layer 520 and also prevent accidental adhesion of gradient permittivity tape 500 to undesired surfaces. Suitable materials for backing layer 530 include plastic films, coated or uncoated paper, or the like. Backing layer 530 may be selected so that it itself does not have strong adhesion to adhesive layer 520, and therefore is easily removable by hand or with limited tools.

Figure 6:
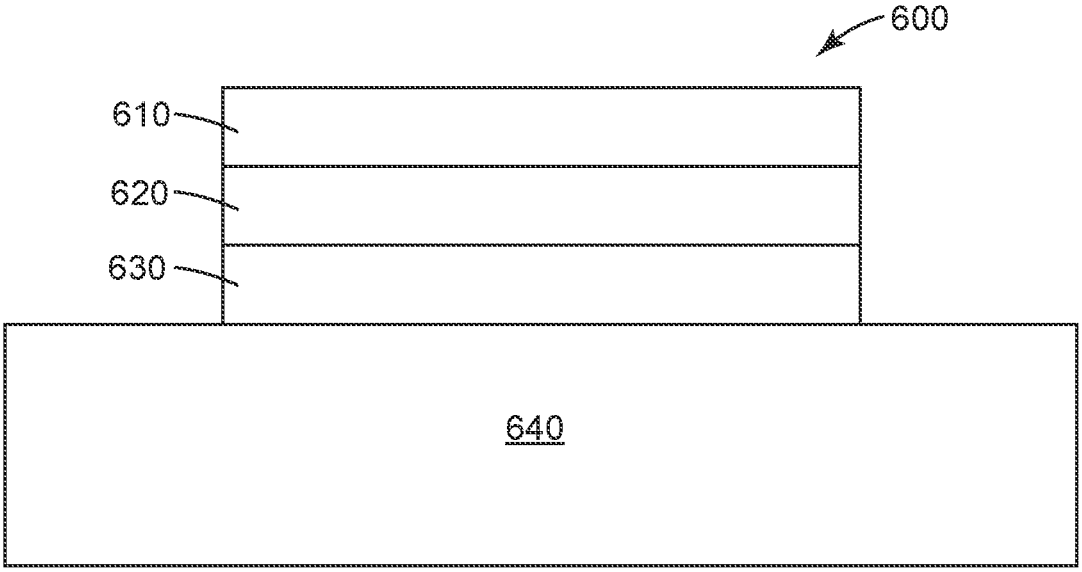
FIG. 6 is a side elevation cross section of a gradient permittivity film attached to a surface.

FIG. 6 is a side elevation cross section of a gradient permittivity film attached to a surface. Assembly 600 includes gradient permittivity film including first perforated layer 610, second perforated layer 620, and adhesive layer 630 attaching the gradient permittivity tape to surface 640.

The gradient permittivity film of FIG. 6 is attached to surface 640 via adhesive layer 630. In some embodiments, gradient permittivity film including first perforated layer 610 and second perforated layer 620 may have been configured as a tape, with adhesive layer 630 disposed on the gradient permittivity film prior to attachment to surface 640, as described and shown in FIG. 5. In some embodiments, the gradient permittivity film is attached to surface 640 by application of adhesive layer 630 at or near the time of attachment. Any suitable adhesive may be used.

Surface 640 may be, in some embodiments, a vehicle fascia. Surface 640 may be a radome. In some embodiments, surface 640 may be a different protective cover or casing, such as an antenna covering or the external surface of an electronic device. In some embodiments, although FIG. 6 illustrates one gradient permittivity film attached to the surface, more than one gradient permittivity tape may be attached to the surface in the same or similar manner. In some embodiments, a second gradient permittivity film is attached to the opposite side of surface 640, with its half having lower relative permittivity being disposed away from surface 640. Surface 640 may be curved or nonplanar, and gradient permittivity film or a tape including such a film may be similarly formed, flexible, or compliant in order to adhere closely to the shape of surface 640.

Gradient permittivity films described herein may be post-processed in order to further tune the properties and performance of these films. For example, gradient permittivity films described here in may be heated or thinned or selectively filled with material in order to change the properties at a certain point or points on the film.

EXAMPLES

The modeled examples included here depict a 4-layer construction using a mesh pattern for each layer. The construction may be installed inside of an automotive bumper/fascia in the line of sight of the vehicle radar sensor. The layers are composed in the versatile microwave modelling tool commercially available as CST Microwave Studio. The CST software tool is used commonly as a 3D electromagnetic simulation tool. In this case, the model is set-up to assess the 77 to 81 GHz—the 79 GHz band—with the modeled film located on the radar head side of the automotive bumper.

Example 1

A 4-layer mesh structure was created in CST Microwave Studio according to the table 1 with Layer 1 set to be adjacent to the fascia/bumper. The (4) mesh layers were stacked to compose the gradient permittivity film. The layer thickness was modelled at 100 micrometer thickness per layer.

TABLE 1

Modeled layer description

| | Mesh size (mm) | Mesh spacing (mm) | Percentage air void | Effective relative permittivity, $\varepsilon_{r\ eff}$ |
|---|---|---|---|---|
| Layer 1 | 0.02 | 0.01 | 11% | 2.66 |
| Layer 2 | 0.01 | 0.01 | 25% | 2.39 |
| Layer 3 | 0.01 | 0.02 | 57% | 1.80 |
| Layer 4 | 0.01 | 0.03 | 75% | 1.47 |

Example 2

In this example, (4) homogeneous layers, each 100 microns thick, were assembled on bumper/fascia material in CST Microwave studio. The bumper/fascia material was presumed to have thickness of 3.0 mm and permittivity, $\varepsilon_r$=2.86−j0.06. The first layer adjoining the bumper was modeled to have permittivity $\varepsilon_r$=2.488−j0. The second layer was modeled to have permittivity $\varepsilon_r$=2.116−j0. The third layer was modeled to have permittivity $\varepsilon_r$=1.744−j0. The fourth layer was modeled to have permittivity $\varepsilon_r$=1.372−j0.

Test Results

Figure 7:
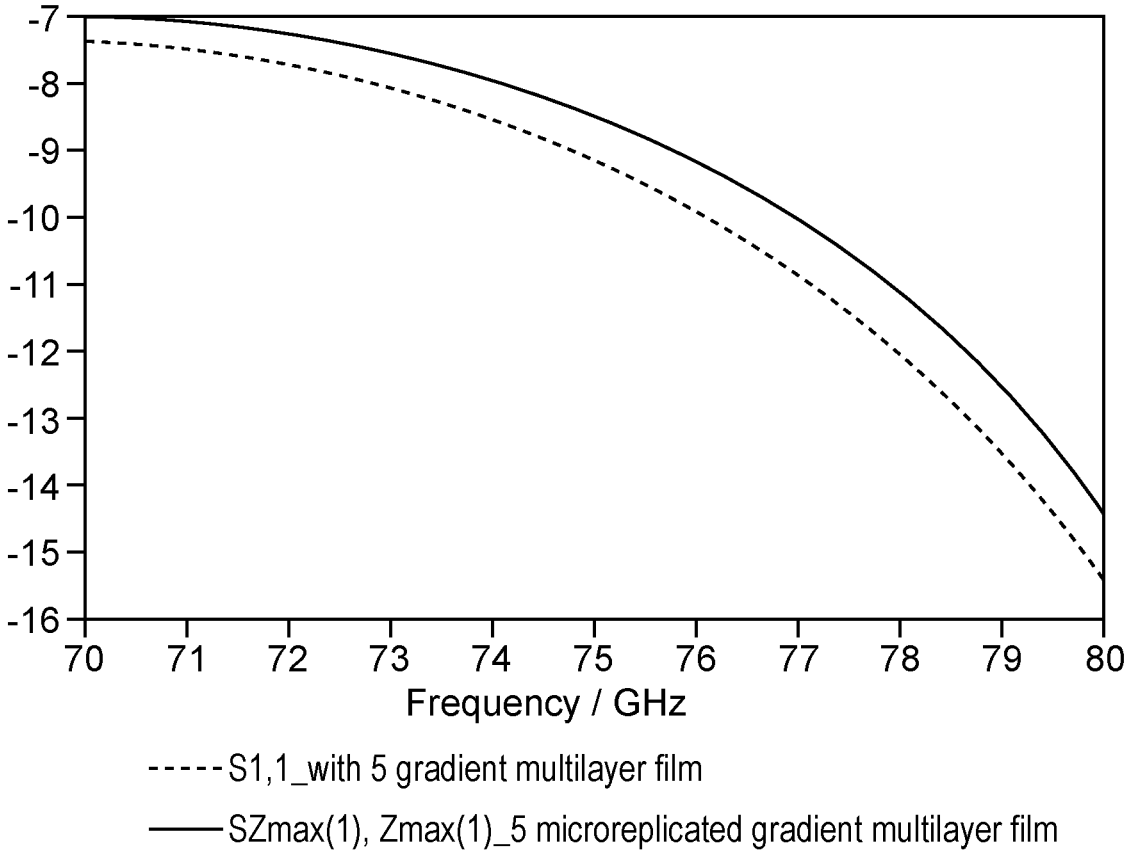
FIG. 7 is a graph of S-parameters for Example 1 and Example 2.

In the CST Microwave Studio model, the 4-layer structures, attached to a 3 mm thick fascia/bumper, were used to calculate the reflection S-parameters. If the mesh structured layer performs similarly to a single homogeneous layer of effective permittivity, this is expected to represent the ideal case for reflection reduction. For this purpose, Example 1, having a 4-layer mesh structure and example 2, having a homogeneous layer structure were compared. FIG. 7 shows $|S_{11}|$ modeling results for the 4-layer mesh construction (Example 1—top trace) and a 4-layer construction with homogeneous layers of equivalent effective permittivity (Example 2—bottom trace). The results indicate that either of the 4-layer structures should be expected to perform very similarly.

Descriptions for elements in figures should be understood to apply equally to corresponding elements in other figures, unless indicated otherwise. The present invention should not be considered limited to the particular examples and embodiments described above, as such embodiments are described in detail in order to facilitate explanation of various aspects of the invention. Rather, the present invention should be understood to cover all aspects of the invention, including various modifications, equivalent processes, and alternative devices falling within the scope of the invention as defined by the appended claims and their equivalents.

What is claimed is:

1. A gradient permittivity film having a first major surface and an opposing second major surface, comprising: a plurality of layers each having a thickness; wherein at least one layer of the plurality of layers is a perforated layer characterized by an average border thickness surrounding each perforation and an average pitch between the centers of each perforation, and an air volume fraction averaged over the thickness of the perforated layer; wherein the perforated layer has a different air volume fraction from another of the plurality of layers by at least 0.05, and wherein each perforation has a perforation axis along the center of each perforation, and at least one perforation has a canting with respect to a thickness direction of the perforated layer, the canting defined by the perforation axis, and the perforation axis varies between two or more perforations along one or more non-thickness directions.

2. The gradient permittivity film of claim 1, wherein at least two layers of the plurality of layers are perforated layers characterized by an average border thickness surrounding each perforation and an average pitch between the centers of each perforation, and an air volume fraction averaged over the thickness of the perforated layer, and the air volume fraction of each of the at least two layers differ by at least 0.05.

3. The gradient permittivity film of claim 1, wherein the plurality of layers includes at least three layers, and at least three layers of the plurality of layers are perforated layers characterized by an average border thickness surrounding each perforation and an average pitch between the centers of each perforation, and an air volume fraction averaged over the thickness of the perforated layer, and the air volume fraction of each of the at least three layers differ by at least 0.05.

4. The gradient permittivity film of claim 1, wherein the plurality of layers includes at least four layers, and at least four layers of the plurality of layers are perforated layers characterized by an average border thickness surrounding each perforation and an average pitch between the centers of each perforation, and an air volume fraction averaged over the thickness of the perforated layer, and the air volume fraction of each of the at least four layers differ by at least 0.05.

5. The gradient permittivity film of claim 1, wherein at least one layer of the plurality of layers is a polymeric layer.

6. The gradient permittivity film of claim 1, wherein the perforated layer has an air volume fraction of at least 0.75.

7. The gradient permittivity film of claim 1, wherein at least one of the average pitch or the average border thickness of the perforated layer varies over the area of the gradient permittivity film.

8. The gradient permittivity film of claim 1, wherein, for each of the at least one layer of the plurality of layers that is a perforated layer, a perforation axis along the center of each perforation does not deviate by more than 30 degrees from a direction along the thickness.

9. The gradient permittivity film of claim 1, wherein, for each of the at least one layer of the plurality of layers that is a perforated layer, a perforation axis along the center of each perforation does not deviate by more than 5 degrees from direction along the thickness.

10. The gradient permittivity film of claim 1, wherein, for each of the at least one layer of the plurality of layers that is a perforated layer, a perforation axis along the center of each perforation varies over the area of the gradient permittivity film.

11. The gradient permittivity film of claim 1, wherein the perforated layer has an average border thickness of between 5 and 30 micrometers.

12. The gradient permittivity film of claim 1, wherein the perforated layer has an average pitch between the centers of each perforation of between 5 and 50 micrometers.

13. A gradient permittivity tape, comprising the gradient permittivity film of claim 1 and an adhesive layer.

14. The gradient permittivity tape of claim 13, further comprising a backing layer disposed on the adhesive layer opposing the gradient permittivity film.

15. An assembly, comprising the gradient permittivity tape of claim 13 attached to a vehicle fascia.

16. An assembly, comprising the gradient permittivity tape of claim 13 attached to an automobile radome.

17. The gradient permittivity film of claim 1, wherein at least one of the plurality of layers includes an absorber.

18. The gradient permittivity film of claim 1, wherein at least one layer of the plurality of layers is coated with an inorganic material different from any material in the at least one layer.

19. The gradient permittivity film of claim 18, wherein the inorganic material is one or more of alumina or titania.

* * * * *